US009545799B2

(12) United States Patent
Naruse

(10) Patent No.: US 9,545,799 B2
(45) Date of Patent: Jan. 17, 2017

(54) APPARATUS AND METHOD FOR PRINTING ON AND CUTTING A CONTINUOUS SHEET

(71) Applicant: CANON KABUSHIKI KAISHA, Tokyo (JP)

(72) Inventor: Taketomo Naruse, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/955,060

(22) Filed: Jul. 31, 2013

(65) Prior Publication Data

US 2014/0036017 A1 Feb. 6, 2014

(30) Foreign Application Priority Data

Jul. 31, 2012 (JP) ..... 2012-169468

(51) Int. Cl.

*B41J 11/66* (2006.01)
*B41J 11/00* (2006.01)
*B41J 11/70* (2006.01)

(52) U.S. Cl.

CPC ..... *B41J 11/663* (2013.01); *B41J 11/006* (2013.01); *B41J 11/70* (2013.01)

(58) Field of Classification Search

CPC ..... B41J 11/008; B41J 11/007; B41J 2202/09
USPC ..... 347/16, 104, 107
See application file for complete search history.

(56) References Cited

U.S. PATENT DOCUMENTS 4,268,943 A 5/1981 Watanabe et al.
4,317,270 A 3/1982 Watanabe et al.
5,532,799 A 7/1996 Watanabe et al.
5,905,520 A * 5/1999 Fujii et al. ..... 347/153
5,915,146 A 6/1999 Kusaka et al.
6,179,287 B1 1/2001 Watanabe et al.
6,240,263 B1 5/2001 Watanabe et al.
6,575,546 B2 6/2003 Matsumoto et al.
7,050,751 B2 5/2006 Watanabe et al.
2011/0211008 A1* 9/2011 Teshigawara et al. ..... 347/16
2011/0279508 A1* 11/2011 Naito ..... 347/16
2013/0088541 A1 4/2013 Naito

FOREIGN PATENT DOCUMENTS

JP 60-009647 U 1/1985
JP H03-197140 8/1991
JP 2002-046260 2/2002
JP 2003-237157 8/2003
JP 4278885 6/2009
JP 2011-177944 A 9/2011

(Continued)

OTHER PUBLICATIONS

U.S. Appl. No. 13/955,036, filed Jul. 31, 2013, Seiya Fujinaga.

(Continued)

*Primary Examiner* — Henok Legesse

(74) *Attorney, Agent, or Firm* — Fitzpatrick, Cella, Harper & Scinto

(57) ABSTRACT

A printing apparatus, including: a printing unit configured to print a plurality of images on a continuous sheet; and a cutting unit configured to cut the continuous sheet per each of the images, wherein, when printing images, information indicating a value obtained by counting the number of the cut sheets cut by the cutting unit is recorded in an area other than the image on the continuous sheet.

14 Claims, 11 Drawing Sheets

(56) References Cited

FOREIGN PATENT DOCUMENTS

| | | |
|---|---|---|
| JP | 2011-240492 | 12/2011 |
| JP | 2011-240493 | 12/2011 |
| JP | 2012-051183 A | 3/2012 |

OTHER PUBLICATIONS

U.S. Appl. No. 13/955,051, filed Jul. 31, 2013, Yuichiro Araki.
U.S. Appl. No. 13/955,072, filed Jul. 31, 2013, Hiroaki Hasegawa.
U.S. Appl. No. 13/955,032, filed Jul. 31, 2013, Minako Adachi.
U.S. Appl. No. 13/955,040, filed Jul. 31, 2013, Norio Shimura.
U.S. Appl. No. 13/955,045, filed Jul. 31, 2013, Taketomo Naruse.
U.S. Appl. No. 13/955,068, filed Jul. 31, 2013, Tatsuya Fukuda.
U.S. Appl. No. 13/955,057, filed Jul. 31, 2013, Taketoshi Kusakabe.
Japanese Office Action issued in corresponding Japanese Application No. 2012-169468 dated May 24, 2016.

* cited by examiner

PRELIMINARY DISCHARGE PATTERN

CUT MARK PATTERN

NON-DISCHARGING MONITORING PATTERN

RECOVERING PROCESS PATTERN

APPARATUS AND METHOD FOR PRINTING ON AND CUTTING A CONTINUOUS SHEET

BACKGROUND OF THE INVENTION

Field of the Invention

The present invention relates to a printing apparatus and method for carrying out printing by using a rolled continuous sheet.

Description of the Related Art

For a great deal of printing, for example, a laboratory print, a rolled continuous sheet is used. There is a printing apparatus configured such that a user sets a rolled continuous sheet, and the printing apparatus feeds the continuous sheet, carries out printing, cuts the continuous sheet by a cutter, and discharges the cut sheet to a sorter.

In an ink jet type printing head, a nozzle having a low frequency in use may be defective in an ink discharge due to an ink clogging or the like. In order to prevent the non-discharging nozzle from being generated, periodical head maintenance is necessary. Even in the case where a plurality of images are printed in the continuous sheet one by one, it is desirable to execute a periodical head maintenance which forms a maintenance pattern in a sheet by discharging inks from all the nozzles per predetermined number of image printing.

In a printing apparatus disclosed in Japanese Patent Laid-Open No. 2011-240492, a non-discharging monitoring pattern and a preliminary discharging pattern for the head maintenance are printed between pages in which images are printed. Hereinafter, kinds of printing except the image designated by the user, for example, the preliminary discharging pattern, the non-discharging monitoring pattern and a cut mark pattern are collectively called as a maintenance pattern.

In an apparatus which prints a plurality of images on a continuous sheet and discharges the continuous sheet after cutting per each image, the following problem is generated in the case where the sheet is clogged due to some reason. In the present specification, sheet clogging in the apparatus and a sheet clogging state are called as a paper jam.

In the case that the paper jam is generated at any one position from a paper supply position to a paper discharge position in the apparatus, it is necessary to stop a whole sheet feeding. Then, cut sheet pieces (cut sheets) are intermittently left in a feed path of the sheet. Although it is necessary for a user to remove the left sheet pieces, there is a case that the sheet piece is left even after the user thought he/she had removed all the sheet pieces. This is because the sheet piece exists not only on the feed path, but the sheet piece is also frequently clogged in an unexpected portion. In the case where a recovering operation is carried out under such the state, not only an error is regenerated, but also a further severe paper jam may be generated.

In order to securely remove all the sheet pieces, it is effective for the user to recognize how many sheet pieces are left in the feed path.

SUMMARY OF THE INVENTION

The present invention is made on the basis of recognition of the problem mentioned above. An object of the present invention is to provide a method of making a user recognize the number of sheet pieces to be handled due to a paper jam in the case that the paper jam is generated during printing images in a continuous sheet.

A printing apparatus according to the present invention for achieving the object mentioned above, includes: a printing unit configured to print a plurality of images on a continuous sheet; and a cutting unit configured to cut the continuous sheet per each of the images, wherein, when printing images, information indicating a value obtained by counting the number of the cut sheets cut by the cutting unit is recorded in an area other than the image on the continuous sheet.

According to the present invention, in the case where a plurality of images are printed in the continuous sheet, the information indicating the number of the cut sheets is recorded on a portion which does not affect a final printed product. In the case where the paper jam is generated, the possibility for a user to securely remove the cut sheets left on the path is increased by viewing the information recorded on the sheet piece.

Further features of the present invention will become apparent from the following description of exemplary embodiments (with reference to the attached drawings).

DESCRIPTION OF THE EMBODIMENTS

A description will be given below of an embodiment of a printing apparatus using an ink jet system. The printing apparatus according to the present embodiment is a high-speed line printer which uses a long and continuous sheet and supports both of a single-sided printing and a double-sided printing. In the present specification, the long and continuous sheet means a continuous sheet in which a length in a sheet feeding direction is longer than a length of a repeated print unit. Further, in the present specification, the repeated print unit means, for example, one page or a unit image. The printing apparatus according to the present embodiment is suitable for a printing field of a larger number of sheets, for example, in a print laboratory or the like. Incidentally, in the present specification, even if there is a case where a plurality of small images, letters or spaces are mixed in an area of one printing unit (one page), those included in the area are collectively called as one unit image. In other words, the unit image means one print unit (one page) in the case where a plurality of pages are printed sequentially in the continuous sheet. Incidentally, the unit image may be simply called as an image. A length of the unit image is different according to a size of the printed image. For example, the length in the sheet feeding direction is 135 mm for a photograph of an L plate size, and the length in the sheet feeding direction is 297 mm for an A4 size. The present invention can be widely applied to a printing apparatus which employs ink and requires drying, such as a printer, a printer complex machine, a copying machine, a facsimile machine, and a manufacturing apparatus for various devices.

Figure 1:
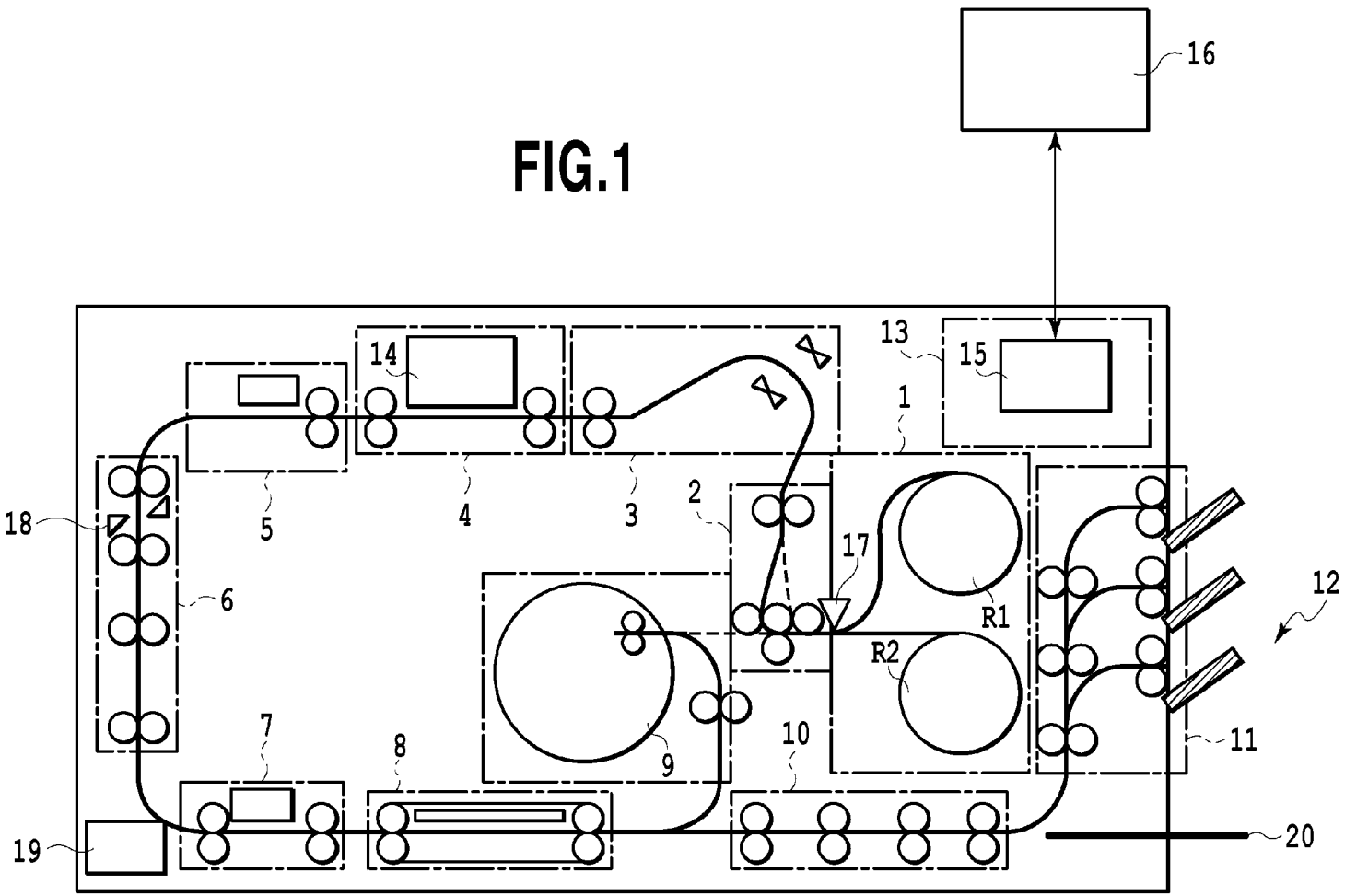
FIG. 1 is a schematic cross-sectional view showing an internal structure of a printing apparatus.

FIG. 1 is a schematic cross-sectional view showing an internal structure of a printing apparatus. The printing apparatus according to the present embodiment employs a rolled sheet and can apply a double-sided printing to a first face of the sheet and a second face that is a back side of the first face. An inner portion of the printing apparatus is roughly provided with respective units of a sheet supply unit 1, a decurling unit 2, an oblique correcting unit 3, a printing unit 4, an inspecting unit 5, a cutter unit 6, an information recording unit 7, a drying unit 8, a reversing unit 9, a discharge feeding unit 10, a sorter unit 11, a discharging unit 12, a control unit 13. The discharging unit 12 refers to the unit which includes the sorter unit 11 and carries out a discharging process. The sheet is fed by a feeding mechanism comprising roller pairs and belts along a sheet feed path which is shown by a solid line in the drawing, and a process is carried out in each of the units. Incidentally, at an arbitrary position of the sheet feed path, a close side to the sheet supply unit 1 is called as "upstream" and an opposite side thereto is called as "downstream".

The sheet supply unit 1 is a unit for holding and supplying the continuous sheet which is wound like a roll. The sheet supply unit 1 can accommodate two rolls of sheets R1 and R2, and is configured to alternatively pull out and supply the sheet. Incidentally, the number of the rolls which can be accommodated is not limited to two, but one roll or three or more rolls may be accommodated. Further, the sheet is not limited to the sheet wound like a roll, as long as the sheet is a continuous sheet. For example, the sheet may be a continuous sheet provided with perforated lines per unit length in which the continuous sheet is folded at every perforated line so as to be laminated, and is accommodated in the sheet supply unit 1.

The decurling unit 2 is a unit which lighten curl (warpage) of the sheet supplied from the sheet supply unit 1. In the decurling unit 2, a decurling force is applied by using two pinch rollers in relation to one drive roller and making the sheet pass through while bending the sheet so as to apply a warpage in a reverse direction to the curl, thereby lightening the curl.

The oblique correcting unit 3 is a unit which corrects an oblique of the sheet that passed through the decurling unit 2. In the present specification, the oblique of the sheet means an incline in relation to a normal travelling direction. The oblique of the sheet is corrected by pressing a sheet edge of a reference side to a guide member. In the oblique correcting unit 3, a loop is formed for the fed sheet.

The printing unit 4 is a sheet processing unit which forms an image on the fed sheet by applying a printing process thereto from the above with a printing head 14. In other words, the printing unit 4 is the processing unit which applies the predetermined process to the sheet. The printing unit 4 is also provided with a plurality of feed rollers which feed the sheet. The printing head 14 has a line type printing head in which an ink jet type nozzle line is formed in a range covering a maximum width of the sheet to be expected to be used. The printing head 14 is structured such that a plurality of printing heads are arranged in parallel along the feeding direction. In the present embodiment, the printing head 14 includes seven printing heads corresponding to seven colors, C (cyan), M (magenta), Y (yellow), LC (light cyan), LM (light magenta), G (gray) and K (black). Incidentally, the number of the colors and the number of the printing heads are not limited to seven. The ink jet system can employ a system using a heater element, a system using a piezoelectric element, a system using an electrostatic element, and a system using an MEMS element or the like. The ink for each of the colors is supplied to the printing head 14 from an ink tank via an ink tube.

The inspecting unit 5 is a unit for determining whether or not the image is accurately printed, by optically reading with a scanner an inspection pattern and an image which is printed on the sheet by the printing unit 4, and inspecting a nozzle state of the printing head, a sheet feed state, and an image position or the like. The scanner has a CCD image sensor or a CMOS image sensor.

The cutter unit 6 is a unit which is provided with a mechanical cutter 18 for cutting the printed sheet at a predetermined length. The cutter unit 6 is further provided with a cut mark sensor for optically detecting a cut mark recorded on the sheet and a plurality of feed rollers for feeding the sheet to the next process. A trash box 19 is provided in the vicinity of the cutter unit 6. The trash box 19 is configured such as to accommodate small sheet pieces which are cut off by the cutter unit 6 so as to be discharged as trash. The cutter unit 6 is provided with a sorting mechanism which discharges the cut sheet to the trash box 19 or transfers the cut sheet to the normal feed path.

The information recording unit 7 is a unit which records the print information (inherent information), for example, serial number and date on a back face which is a face opposite to a face subject for printing of a product by the printing unit 4 in the sheet. The recording is carried out by printing letters or codes according to an ink jet system, a thermal transfer system or the like.

The drying unit 8 is a unit for drying the applied ink for a short time by heating the sheet which is printed by the printing unit 4. In an inner portion of the drying unit 8, the ink applied face is dried by applying hot wind to the passing sheet at least from a lower face side. Incidentally, the drying system is not limited to the system which applies the hot wind, but may employ a system which irradiates electromagnetic wave (ultraviolet light, infrared light or the like) to the surface of the sheet.

The sheet feed path from the sheet supply unit 1 to the drying unit 8 is called as a first path. The first path has a shape which is U-turned between the printing unit 4 and the drying unit 8, and the cutter unit 6 is positioned in the middle of the U-turn shape.

The reversing unit 9 is a unit for temporarily winding and reversing the continuous sheet which is finished with the front face printing in the case where the double-sided print is carried out. The reversing unit 9 is provided in the track of a path (a loop path) (called as a second path) which runs into the printing unit 4 from the drying unit 8 via the decurling unit 2, for again supplying the sheet that passed through the drying unit 8 to the printing unit 4. The reversing unit 9 is provided with a winding rotary body (drum) which rotates for winding the sheet. The continuous sheet which is finished with the printing of the front face and is not cut is temporarily wound to the winding rotary body. After the winding, the winding rotary body reversely rotates, and the wound sheet is fed out in a reverse order to the case of winding so as to be supplied to the decurling unit 2, and is fed to the printing unit 4. Since the sheet is reversed, it is possible to print on a back face by the printing unit 4. On the assumption that the sheet supply unit 1 is a first sheet supply unit, the reversing unit 9 can be assumed as a second sheet supply unit.

The discharge feeding unit 10 is a unit for feeding the sheet which is cut by the cutter unit 6 and is dried by the drying unit 8 and transferring the sheet to the sorter unit 11. The discharge feeding unit 10 is provided in a path (called as a third path) which is different from the second path provided with the reversing unit 9. In order to selectively guide the sheet which is fed along the first path to any one of the second path and the third path, a path switching mechanism having a movable flapper is provided at a branch position (called as "discharge branch position") of the path.

The discharging unit 12 including the sorter unit 11 is provided at a terminal end of the third path and at a side portion of the sheet supply unit 1. The sorter unit 11 is a unit for sorting the printed sheet per group as occasion demands. The sorted sheet is discharged to a plurality of trays which are included in the discharging unit 12. As mentioned above, the third path is laid out in such a manner that it passes through the lower side of the sheet supply unit 1 and discharges the sheet to a side opposite to the printing unit 4 and the drying unit 8 by sandwiching the sheet supply unit 1.

As mentioned above, the units from the sheet supply unit 1 to the drying unit 8 are provided in sequence in the first path. A forward side of the drying unit 8 is branched into the second path and the third path, the reversing unit 9 is provided in the track of the second path, and a forward side of the reversing unit 9 is merged with the first path. The discharging unit 12 is provided in a terminal end of the third path.

The control unit 13 is a unit which carries out control of each of the units in a whole of the printing apparatus. The control unit 13 has a CPU, a memory device, a controller provided with various control parts, an external interface, and an operation unit 15 through which information is input by a user and is output for a user. An operation of the printing apparatus is controlled on the basis of a command from a host device 16, for example, the controller or a host computer which is connected to the controller via the external interface.

Figure 2:
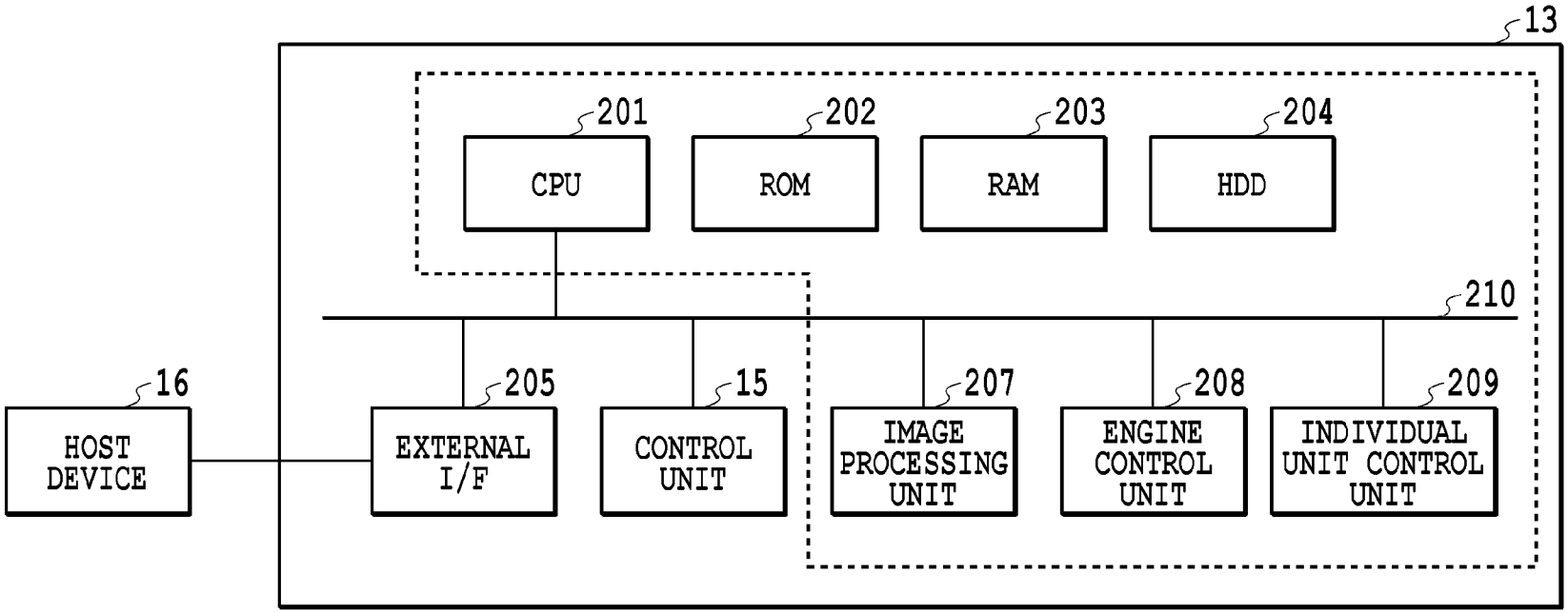
FIG. 2 is a block diagram showing an electric structure of a control unit.

FIG. 2 is a block diagram showing a concept of the control unit 13. The controller (a range surrounded by a broken line) included in the control unit 13 comprises a CPU (central processing unit) 201, a ROM 202, a RAM 203, a HDD (hard disc drive) 204, an image processing unit 207, an engine control unit 208, and an individual unit control unit 209. The CPU 201 controls an operation of each of the units of the printing apparatus in an integrative manner. The ROM 202 stores programs which the CPU 201 executes, and fixed data which is necessary for various operations of the printing apparatus. The RAM 203 is used as a work area of the CPU 201, is used as a temporary storing area for various received data, and stores various setting data. The cut number of the continuous sheet is recorded here. The HDD 204 can store and read out the programs which the CPU 201 executes, print data, and setting information which is necessary for the various operations of the printing apparatus. The operation unit 15 is an input and output interface for the user, and includes an input unit, for example, a hard key and a touch panel, and an output unit, for example, a display providing information and a voice generator.

A dedicated processing unit is provided for a unit which demands a high-speed data processing. The image processing unit 207 carries out an image processing of print data which is handled by the printing apparatus. A color space (for example, YCbCr) of the input image data is converted into a standard RGB color space (for example, sRGB). Further, various image processing, for example, a resolution conversion, an image analysis and an image correction is applied to the image data as occasion demands. The print data obtained by the image processing is stored in the RAM 203 or the HDD 204. The engine control unit 208 carries out drive control of the printing head 14 of the printing unit 4 corresponding to the print data on the basis of the control command received from the CPU 201 or the like. The engine control unit 208 further carries out control of the feeding mechanism for each of the units within the printing apparatus. The individual unit control unit 209 is a sub controller for individually controlling each of the units including the sheet supply unit 1, the decurling unit 2, the oblique correcting unit 3, the inspecting unit 5, the cutter unit 6, the information recording unit 7, the drying unit 8, the reversing unit 9, the discharge feeding unit 10, the sorter unit 11, and the discharging unit 12. The individual unit control unit 209 controls the operation of each of the units on the basis of the command from the CPU 201. The external interface 205 is an interface (I/F) for connecting the controller to the host device 16, and is a local I/F or a network I/F. The constituting elements mentioned above are connected via a system bus 210.

The host device 16 is a device serving as a supply source of the image data for making the printing apparatus carry out the printing. The host device 16 may be a general purpose computer or a dedicated computer, or may be dedicated image equipment, for example, an image capture having an image reader unit, a digital camera or photo storage. In the case where the host device 16 is a computer, an OS, an application software creating the image data, and a printer driver for the printing apparatus are installed in the memory device included in the computer. Incidentally, it is not essential to execute all the processes mentioned above by software, a partial process or all the process may be executed by hardware.

Subsequently, a basic operation in printing will be described. Since the operation is different between a single-sided print mode and a double-sided print mode in the printing, each of the operations will be described.

In the single-sided print mode, the sheet which is supplied from the sheet supply unit 1 and is processed by each of the decurling unit 2 and the oblique correcting unit 3 is printed on its front face (first face) in the printing unit 4. A plurality of images are formed side by side in the long continuous sheet, by sequentially printing images (unit images) each having a predetermined unit length in the feeding direction. The printed sheet is passed through the inspecting unit 5 and is cut per unit image by the cutter unit 6. Print information is recorded on a back face of the cut sheet after being cut by the information recording unit 7 as occasion demands. Further, the cut sheets are fed one by one to the drying unit 8 so as to be dried. Thereafter, the cut sheets are sequentially discharged to the discharging unit 12 of the sorter unit 11 via the discharge feeding unit 10 so as to be stacked. On the other hand, the sheet which is left in a side of the printing unit 4 by cutting the final unit image is turned back to the sheet supply unit 1, and the sheet is wound up on the roll R1 or R2. As mentioned above, in the single-sided printing, the sheet is processed while passing through the first path and the third path; and the sheet does not pass through the second path.

On the other hand, in the double-sided print mode, a back face (second face) print sequence is executed next to a front face (first face) print sequence. In the first front face print sequence, an operation in each of the units from the sheet supply unit 1 to the inspecting unit 5 is the same as the operation of the single-sided printing mentioned above. A cutting operation is not carried out in the cutter unit 6, and the sheet is maintained in its continuous form while being fed to the drying unit 8. After drying the ink on the front face by the drying unit 8, the sheet is guided to the path (the second path) in a side of the reversing unit 9 in place of the path (the third path) in a side of the discharge feeding unit 10. The sheet is wound up on the winding rotary body of the reversing unit 9 which turns in a forward direction (a counterclockwise direction in the drawing) in the second path. In the case where all the planned printing of the front face is finished in the printing unit 4, a rear end of the printed area of the continuous sheet is cut by the cutter unit 6. With reference to the cut position, the continuous sheet in a downstream side (a printed side) in the feeding direction is wound up until the rear end (the cut position) of the sheet by the reversing unit 9 via the drying unit 8. On the other hand, in parallel with winding in the reversing unit 9, the continuous sheet which is left in an upstream side (a side of the printing unit 4) in the feeding direction from the cut position is fed back to the sheet supply unit 1 so that a leading end (the cut position) of the sheet does not stay in the decurling unit 2, and the sheet is wound up on the roll R1 or R2. By this turning back (back feed), collision with the sheet which is again supplied according to the following back face print sequence can be avoided.

After the front face print sequence mentioned above, the sequence is switched to the back face print sequence. The winding rotary body of the reversing unit 9 turns in a reverse direction (a clockwise direction in the drawing) to the direction in the case of winding up. An end portion of the wound sheet (the sheet rear end in the case of winding up is the sheet leading end in the case of feeding) is fed into the decurling unit 2 along a path shown by a broken line in the drawing. In the decurling unit 2, the curl applied by the winding rotary body is corrected. In other words, the decurling unit 2 is provided between the sheet supply unit 1 and the printing unit 4 in the first path, and between the reversing unit 9 and the printing unit 4 in the second path, and is a common unit which serves to decurl in any of the paths. The sheet whose front and back faces are reversed is fed to the printing unit 4 via the oblique correcting unit 3, and the printing is applied to the back face of the sheet. The printed sheet is passed through the inspecting unit 5 and is cut per a predetermined unit length which is previously set in the cutter unit 6. The cut sheets are fed one by one to the drying unit 8, and are sequentially discharged to the sorter unit 11 of the discharging unit 12 via the discharge feeding unit 10 so as to be loaded. As mentioned above, in the double-sided printing, the sheet is processed by sequentially passing through the first path, the second path, the first path and the third path.

Figure 3:
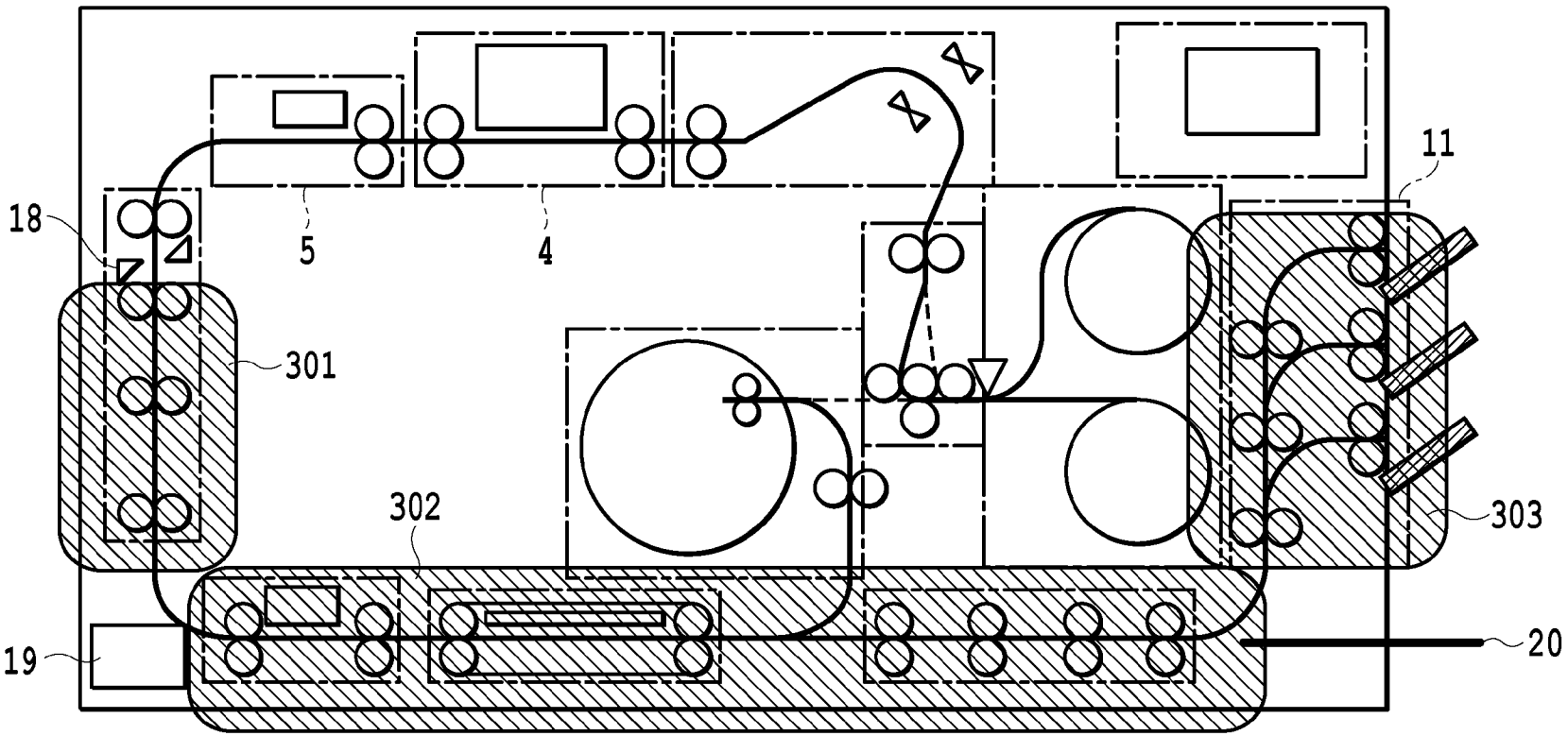
FIG. 3 is a view showing classification of feed paths.

FIG. 3 is a view for describing how the sheet piece passes through in the path within the printing apparatus. The continuous sheet to which the printing of the unit image and the maintenance pattern is applied by the printing unit 4 is fed to the cutter 18 within the path while being maintained in its continuous form, and is cut into the respective sheet pieces of the unit images and the maintenance patterns by the cutter 18. In a path 301 shown in FIG. 3, all the sheet pieces of the unit images and the maintenance patterns are fed. In the case where the sheet pieces reach the trash box 19, the sheet pieces of the maintenance patterns having a length which is equal to or less than a predetermined length are thrown out into the trash box 19. In the present embodiment, the sheet pieces of a cut mark pattern (FIG. 6B) and a non-discharging monitoring pattern (FIG. 6C) in the maintenance patterns are thrown out into the trash box. Further, the sheet pieces of a preliminary discharge pattern (FIG. 6A) and a recovering process pattern (FIG. 6D), and the sheet pieces of the unit images in the maintenance patterns go to a path 302. In the case where the sheet pieces pass through the path 302 and reach a waste sheet discharging unit 20, the sheet pieces of the maintenance pattern having a length which is equal to or longer than a predetermined length, and the sheet pieces of the images which are the unit images but are determined as being not correctly printed by the inspecting unit 5 are discharged. Only the sheet pieces on which the unit images are correctly printed go to a path 303, and are discharged to the sorter unit 11.

Figure 4:
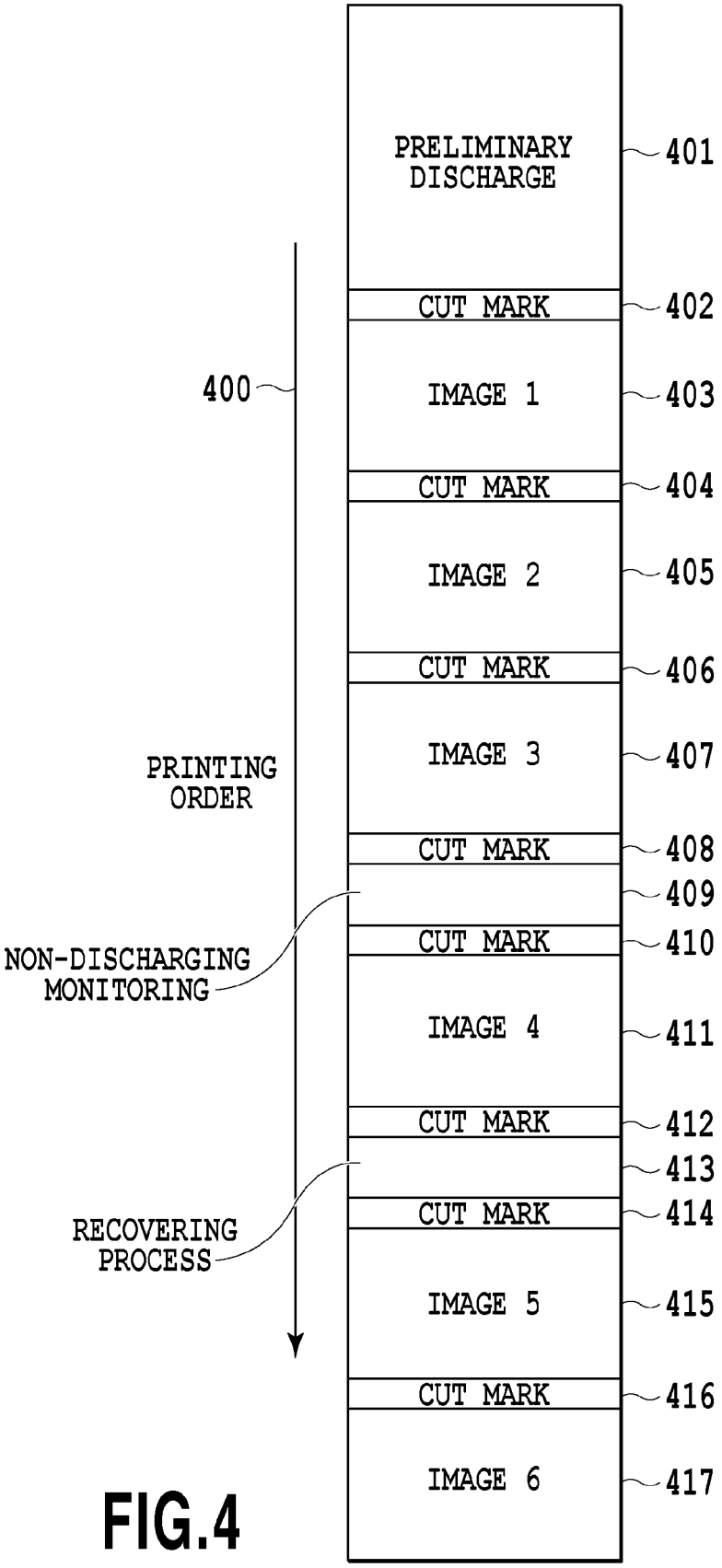
FIG. 4 is a view showing a pattern of printing.

FIG. 4 shows a printing order that the unit images and the maintenance patterns are sequentially printed on the continuous sheet. A printing order 400 indicates an order of printing on the continuous sheet. The kind of the printing includes the maintenance patterns in addition to the unit images. The maintenance patterns include a non-discharging monitoring pattern, a preliminary discharge pattern, a recovering process pattern and a cut mark pattern. In the example in FIG. 4, printing is carried out in the order of a preliminary discharge pattern 401, a cut mark pattern 402, a unit image 1 (403), . . . , and a unit image 6 (417) from a leading end of the sheet. The maintenance pattern is printed according to a fixed order, however, since the non-discharging monitoring pattern and the recovering process pattern are frequently printed in the case where the non-discharging in which the ink is not correctly discharged is generated, the user can not necessarily recognize the pattern.

Figure 5A:
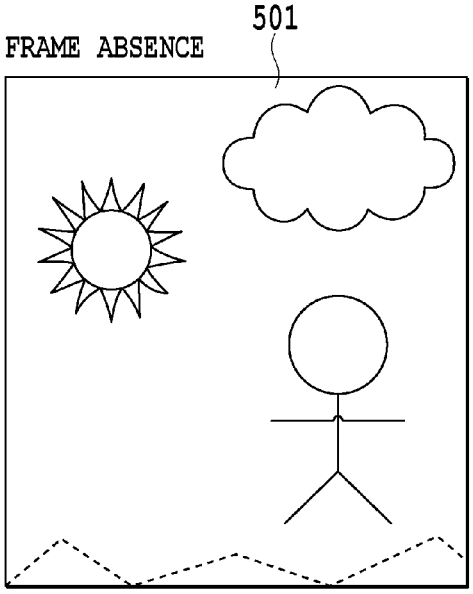
FIGS. 5A to 5C are views showing examples of unit images.
Figure 5B:
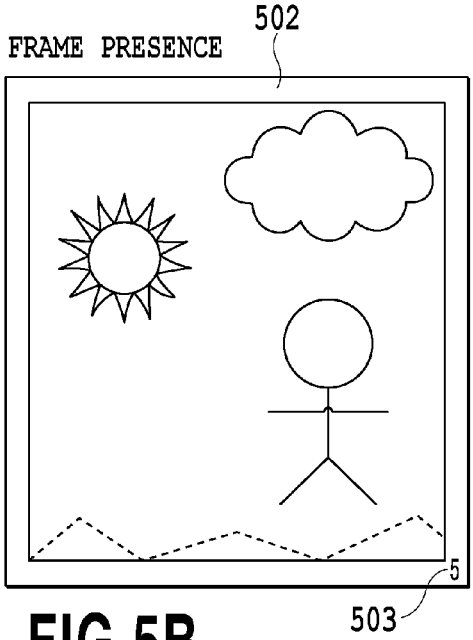
Figure 5C:
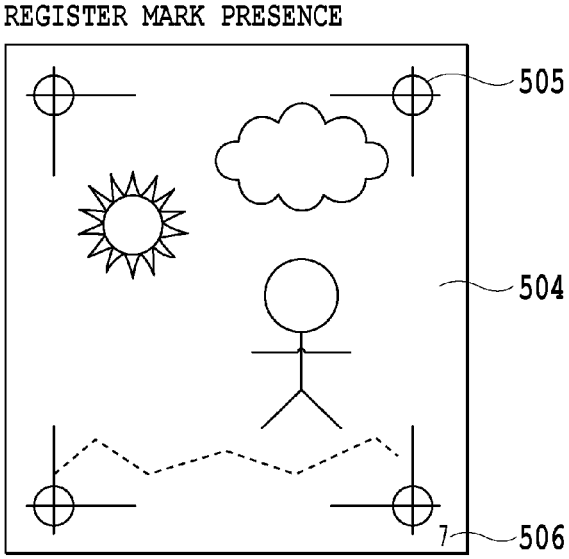

FIGS. 5A to 5C are views showing examples of the unit images. FIG. 5A shows "frame absence" corresponding to a pattern in which an image is printed in a whole face of the unit image. Since the frame absence image does not have a margin area in adjacent to the image, the cut number cannot be printed. FIG. 5B shows "frame presence" corresponding to a pattern in which a white frame is formed around the printed unit image. The frame presence image is used in the case where a photograph is printed, or is printed on the assumption that the printed image is cut. Since the white frame portion is not associated with the image, a cut number 503 (numeral "5" in the present example) can be printed. The cut number is printed in the case of the frame presence in the first embodiment, however, it is possible to set so that the cut number is not printed according to an intended use. FIG. 5C shows "register mark presence" corresponding to a pattern to which a register mark 505 serving as a register index is added. Since the register mark presence image is assumed to be cut so as to remove four corners thereof, a cut number 506 (numeral "7" in the present example) can be printed in the portion to be removed.

Figure 6A:
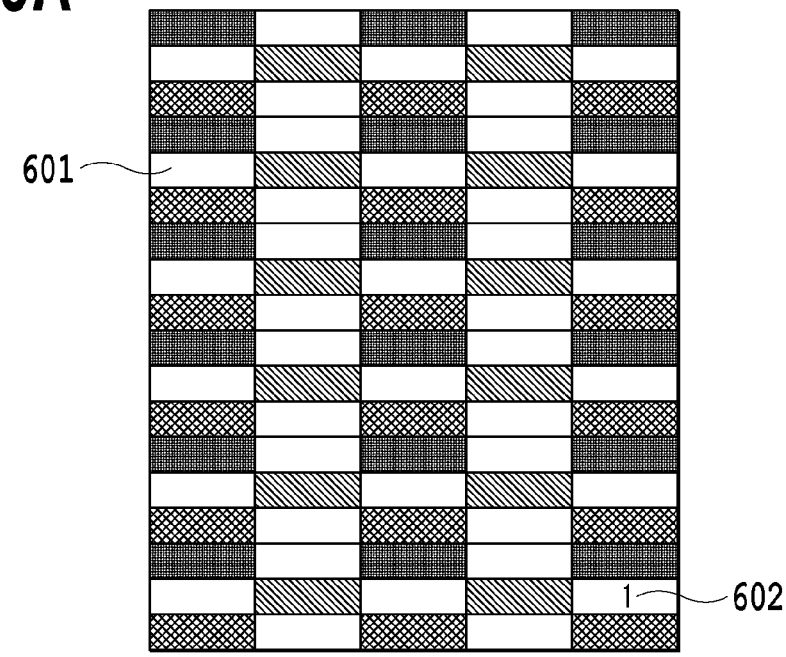
FIGS. 6A to 6D are views showing examples of maintenance patterns.
Figure 6B:
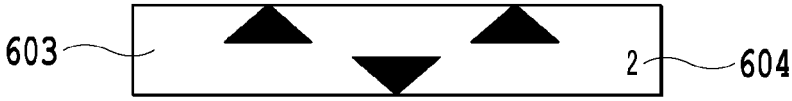
Figure 6C:
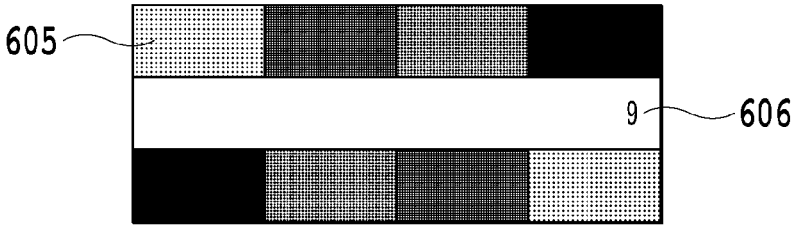
Figure 6D:
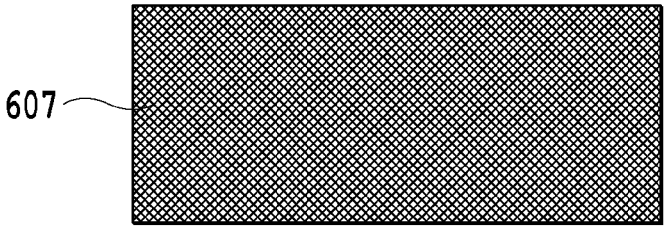

FIGS. 6A to 6D are views showing examples of the maintenance patterns. FIG. 6A shows "preliminary discharge pattern" which is a pattern to be printed after a no-printing period continues, and is printed mainly at the head of the printing. In the present example, a cut number 602 (numeral "1" in the present example) is printed in a margin area in a whole picture 601 of the preliminary discharge pattern. Since the margin area cannot be sometimes secured according to a forming way of the preliminary discharge pattern, the cut number 602 may not be printed in such a case. FIG. 6B shows "cut mark pattern" corresponding to an example of a pattern which a cut mark sensor of the cutter unit 6 reads. Since a sufficient margin area is provided in a whole picture 603 of the cut mark pattern according to the present example, a cut number 604 (numeral "2" in the present example) can be printed. FIG. 6C shows "non-discharging monitoring pattern" corresponding to a pattern which the inspecting unit 5 uses for inspecting. Since a sufficient margin area is provided in a whole picture 605 of the non-discharging monitoring pattern according to the present example, a cut number 606 (numeral "9" in the present example) can be printed. FIG. 6D shows "recovering process pattern" corresponding to a pattern for recovering in the case where the non-discharging is found. Since the printed recovering process pattern is checked by the inspecting unit 5 to see whether or not the non-discharging is recovered, a cut number which changes every time cannot be printed on the recovering process pattern.

In the first embodiment, a description will be given of a printing flow for determining whether or not the cut number will be printed depending on whether the kind of the printing is the unit image or the maintenance pattern.

Figure 7A:
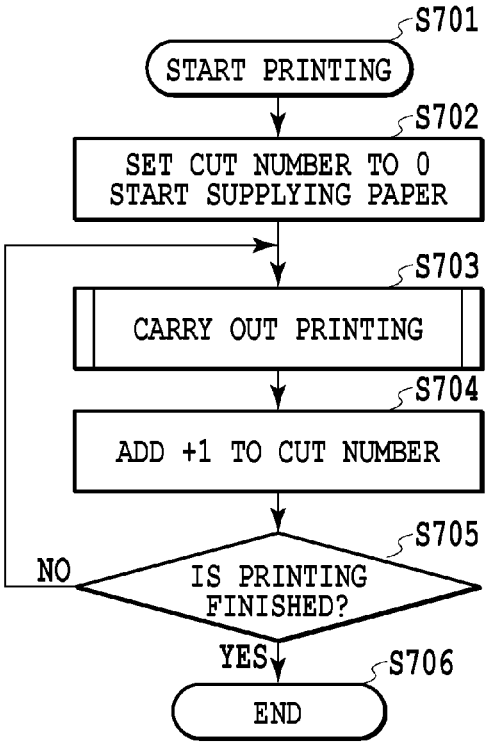
FIGS. 7A and 7B are flow charts showing a printing process.
Figure 7B:
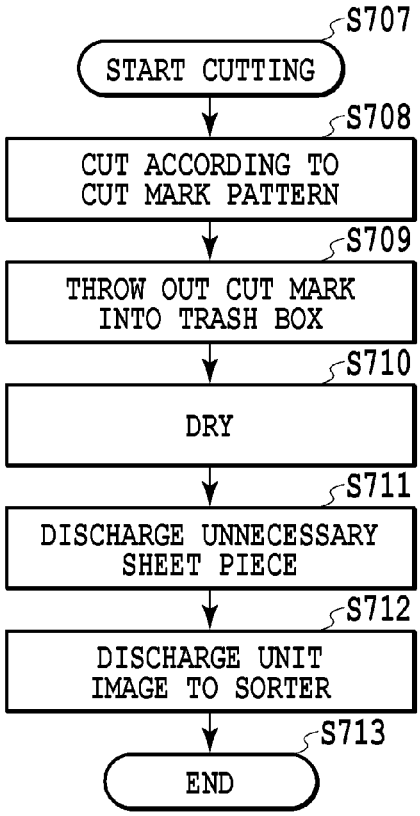

First of all, a description will be given of a single-sided printing flow for printing to one side of the sheet, referring to FIG. 7A and FIG. 7B. FIG. 7A shows a flow from a paper supply to an end of the printing. FIG. 7B shows a flow from the cutting to the discharging. The flow of FIG. 7B is started at a just timing that the continuous sheet printed by processes in the flow in FIG. 7A reaches the cutting unit 6.

The printing is started in step S701 in FIG. 7A, and the process goes to step S702. In step S702, the printing apparatus resets a count value of the number of cut sheets to 0 (zero), and thereafter supplies the continuous sheet by using the sheet supply unit 1, and the process goes to step S703. In step S703, the printing apparatus prints a desired pattern on the continuous sheet by using the printing unit 4, and the process goes to step S704. A description will be in detail given later of step S703 with reference to FIG. 8.

In step S704, one is added to the count value of the number of cut sheets ("+1"), and the process goes to step S705. Step S705 determines whether or not the data of the image to be printed by the printing unit 4 is finished. In the case where step S705 determines that the data of the image to be printed is left yet, the process goes to step S703, and thereafter the following steps are again carried out according to the flow. In the case where step S705 determines that the data of the image to be printed is finished, the process goes to step S706, and the present flow is finished.

The cutting is started in step S707 in FIG. 7B, and the process goes to step S708. In step S708, the cutter unit 6 cuts the continuous sheet into the unit image and the maintenance pattern by using the cutter 18 in the case of finding the cut mark, and the process goes to step S709. In step S709, the sheet pieces of the cut mark pattern (FIG. 6B) and the non-discharging monitoring pattern (FIG. 6C) are thrown out into the trash box 19, and the process goes to step S710. In step S710, the other sheet pieces which are not thrown out are dried by using the drying unit 8, and the process goes to step S711. Step S711 discharges the sheet pieces (unnecessary sheet pieces) of the preliminary discharge pattern (FIG. 6A), the recovering process pattern (FIG. 6D), and the image which is the unit images but is determined as being not correctly printed by the inspecting unit 5, and goes to step S712. Step S712 discharges the sheet piece of the unit image which is correctly printed to the sorter unit 11, and the present flow is finished.

Figure 8:
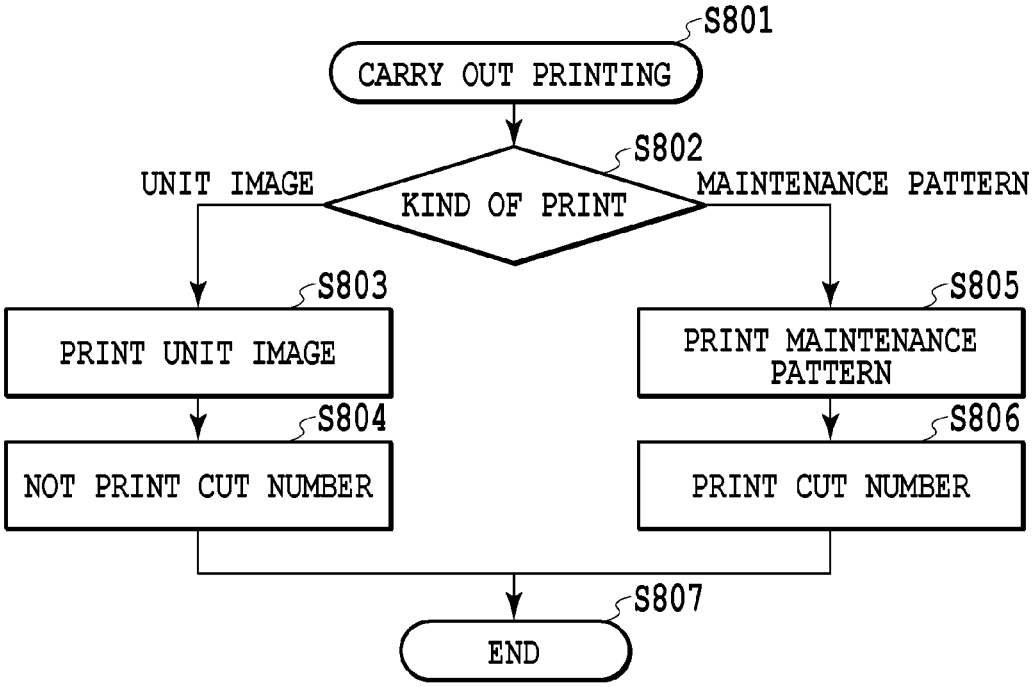
FIG. 8 is a flow chart for describing an operation of an embodiment.

A description will be given of a flow for determining whether or not the cut number will be printed, with reference to FIG. 8. The printing is started in step S801 in FIG. 8, and the process goes to step S802. Step S802 determines the kind of the printing. Specifically, the step determines whether the image to be printed by the printing unit 4 is the unit image or the maintenance pattern. In the case where the kind of the printing is determined to be the unit image, the process goes to step S803, and in the case where the kind of the printing is determined to be the maintenance pattern, the process goes to step S805. The printing unit 4 prints the designated unit image in step S803 and does not print the cut number (substantially executes nothing) in step S804, the process goes to step S807, and the present flow is finished. The printing unit 4 prints the designated maintenance pattern in step S805 and further prints the cut number (the number of the cut sheets) in the vicinity of the maintenance pattern in step S806, the process goes to step S807, and the present flow is finished.

A specific effect obtained by executing the first embodiment is achieved in the paper jam case during the printing. In the case that the paper jam is generated, it is necessary for the user to remove the sheet pieces (the cut sheets in which the images are printed) over a whole area of the paths of the sheet. For example, in the case where it is intended to remove the sheet pieces in the path 301, all the cut numbers recorded on the sheet pieces of the maintenance pattern in the trash box 19 are checked. Next, the cut number at the head of the continuous sheet which is positioned in the cutter unit 6 just before the cutting is checked. As a result, it is possible to know the number of the sheet pieces existing in the path 301. Further, in the case where it is intended to remove the sheet pieces in the path 302, first of all, the cut numbers of the sheet pieces of the maintenance pattern in the trash box 19 are checked. Next, by checking the cut numbers of the unnecessary sheet pieces discharged to the waste sheet discharge unit 20 and the number of the sheet pieces in the path 303, the number of the sheet pieces existing in the path 302 can be recognized. In the case where the number of the sheet pieces is finally incompatible, it is necessary to set out all the removed sheet pieces in a sequential order. Since the cut number is printed and the printing order can be reproduced, not only it is possible to prevent the sheet pieces from failing to be picked up, but also it is possible to estimate what position of the path the sheet piece is left.

Figure 11:
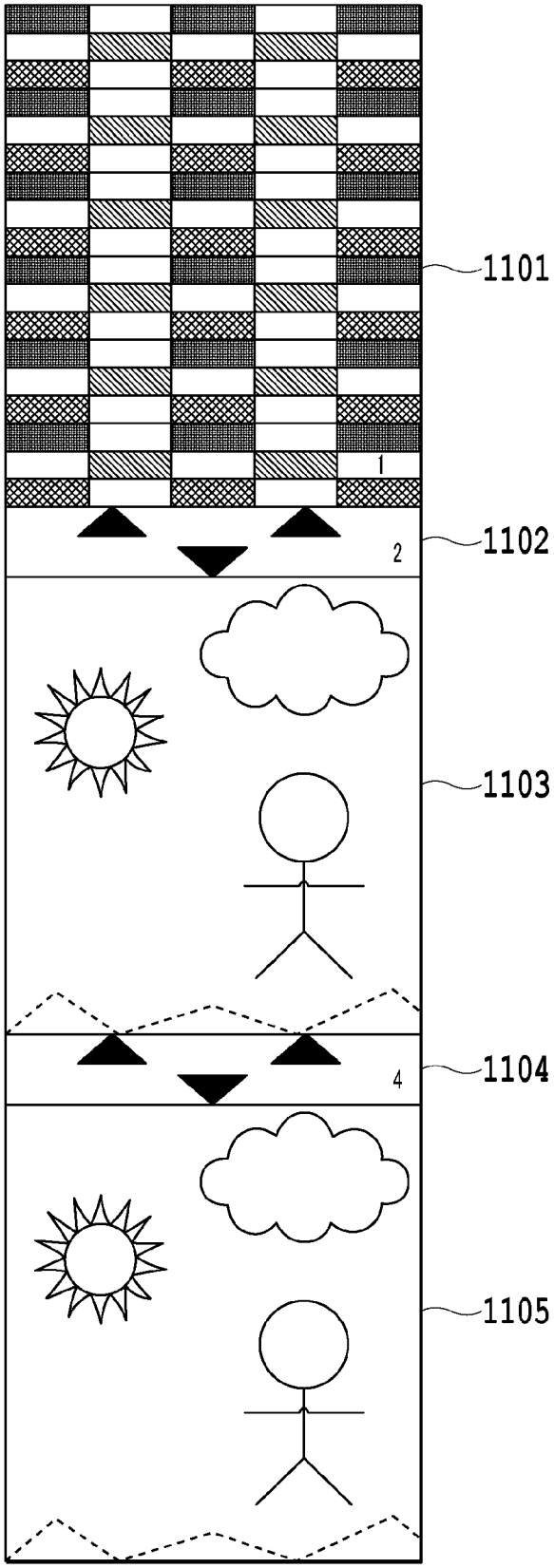
FIG. 11 is a view showing a print example of an operation of a first embodiment.

A description will be given specifically of an example which executes the flow in FIG. 8 with reference to FIG. 11. A preliminary discharge pattern 1101 is printed in the first page. Since the preliminary discharge pattern is the maintenance pattern, the printing of the cut number is determined according to the flow in FIG. 8. Therefore, "1" is printed in a margin area. A cut mark pattern 1102 is printed in the second page. Since the cut mark pattern is the maintenance pattern, the printing of the cut number is determined according to the flow in FIG. 8. Therefore, "2" is printed in a margin area. A frame absence image 1103 is printed in the third page. Since the frame absence image is the unit image, the cut number is not printed according to the flow in FIG. 8. Therefore, the cut number "3" is not printed. Since a cut mark pattern 1104 is printed in the fourth page, the same process is carried out as the second page in which the cut mark pattern 1102 is printed (the cut number printing is executed). Since a frame absence image 1105 is printed in the fifth page, the same process is carried out as the third page in which the frame absence image 1103 is printed (the cut number printing is not executed).

In the first embodiment, the printing of the cut number is not carried out without variation in the case where the kind of the printing is the unit image. On the contrary, in the second embodiment, there is shown an example in which the cut number is printed in the case where the kind of the printing is the unit image.

Specifically, in the second embodiment, a description will be given of a printing flow for determining whether or not the cut number is printed in the unit image. The printing flow according to the second embodiment is in common with the printing flow according to the first embodiment which is described with reference to FIGS. 7A and 7B, except step S703. A description of the common portions will be omitted, and a description will be given in detail of the different step S703 with reference to FIGS. 9A and 9C.

Figure 9A:
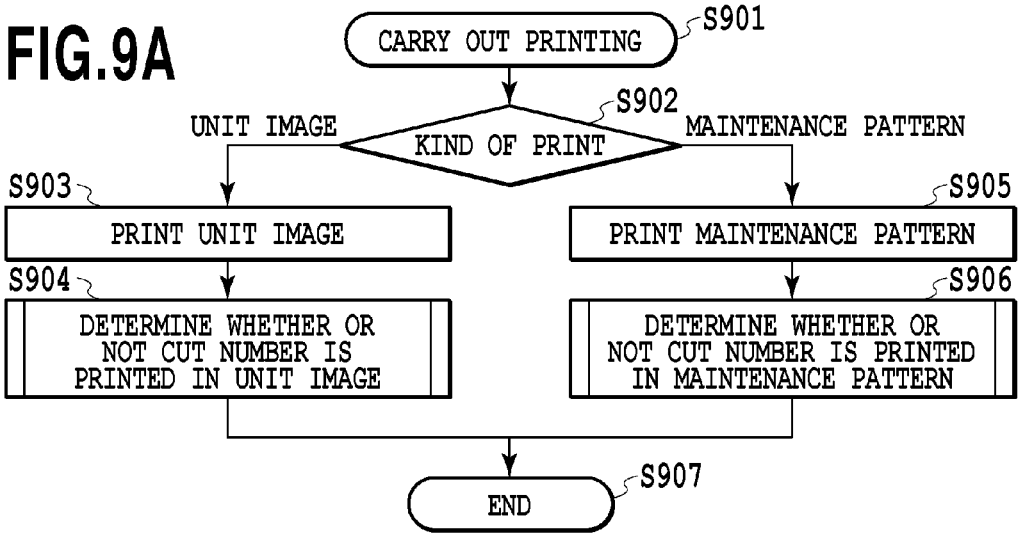
FIGS. 9A to 9C are flow charts for describing operations of second and third embodiments.

In step S901 in FIG. 9A, the printing is executed and the process goes to step S902. In step S902, the kind of the printing, namely whether the image to be printed by the printing unit 4 is the unit image or the maintenance pattern is determined. In the case where the kind of the printing is determined to be the unit image in step S902, the process goes to step S903 so as to print the unit image, and the process goes to step S904. The case where the kind of the printing is determined to be the maintenance pattern in step S902 will be mentioned later as a third embodiment.

Figure 9B:
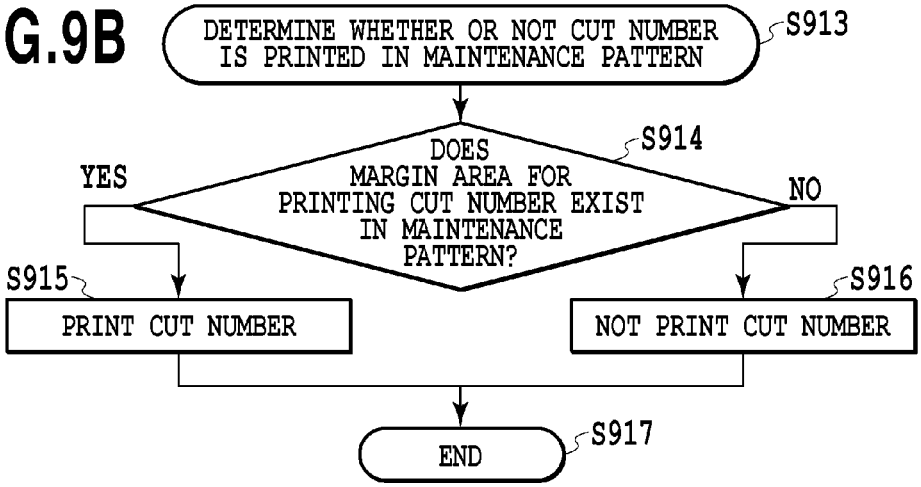
Figure 9C:
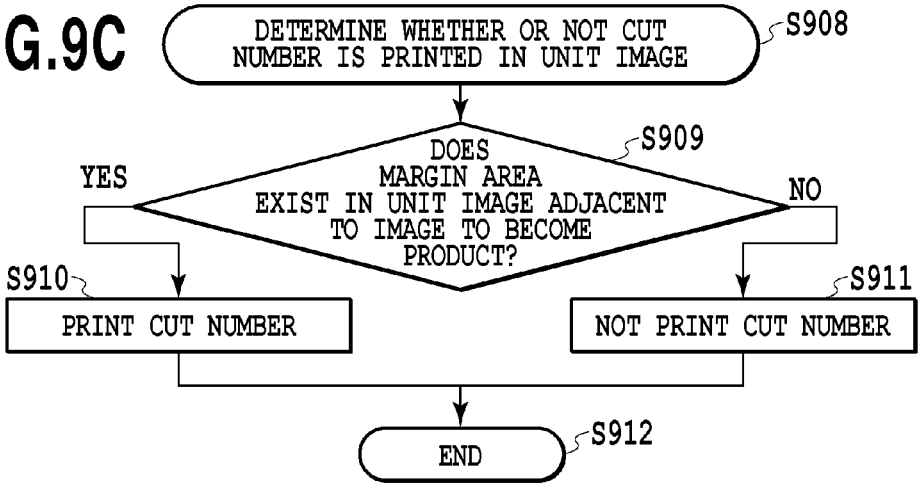

Step S904 will be described in detail with reference to FIG. 9C. A determining process is started in step S908 in FIG. 9C, and the process goes to step S909. In step S909, it is determined whether or not a margin area exists adjacent to an image to become a product in the unit image. In the case where the margin area exists, the process goes to step S910, the cut number (the number of the cut sheets) is printed, the process goes to step S912 and the present flow is finished. In the case where the margin area does not exist, the process goes to step S911, the cut number is not printed, the process goes to step S912 and the present flow is finished. Next, the process turns back to the flow in FIG. 9A and the process goes to step S907, and the flow for executing the printing is finished.

In step S909, it is determined that a margin area adjacent to the image does not exist in the case of the frame absence (FIG. 5A), and it is determined that a margin area adjacent to the image exists in the case of the frame presence or the register mark presence (FIG. 5B or 5C), according to the example of the unit image described with reference to FIGS. 5A to 5C. The present determination is an example, and the determination whether or not the cut mark is printed may be changed according to an intended use of the printed product.

An effect obtained by executing the second embodiment exists in a point that the possibility of printing the cut number is higher, in addition to the effect of the first embodiment.

In the first embodiment, the printing of the cut number is carried out without variation in the case where the kind of the printing is the maintenance pattern. On the contrary, in the third embodiment, there is shown an example in which the cut number is not printed in the case where the kind of the printing is the maintenance pattern.

Specifically, in the third embodiment, a description will be given of a printing flow for determining whether or not the cut number is printed in the maintenance pattern. The printing flow according to the third embodiment is different from the printing flow according to the second embodiment mentioned above in steps from step S902 to step S907 in FIG. 9A. A description of the common portions will be omitted, and a description will be given in detail of the different steps with reference to FIGS. 9A and 9B.

As mentioned above, in step S902 in FIG. 9A, the kind of the printing, namely whether the image to be printed by the printing unit 4 is the unit image or the maintenance pattern is determined. In the case where it is determined in step S902 that the kind of the printing is the maintenance pattern, the process goes to step S905, the maintenance pattern is printed, and the process goes to step S906.

A description will be given in detail of step S906 with reference to FIG. 9B. A determining process is started in step S913 in FIG. 9B, and the process goes to step S914. In step S914, it is determined whether or not a margin area exists in the maintenance pattern. In the case where the margin area exists, the process goes to step S915, the cut number (the number of the cut sheets) is printed, the process goes to step S917 and the present flow is finished. In the case where a margin area does not exist, the process goes to step S916, the cut number is not printed, the process goes to step S917 and the present flow is finished. Next, the process turns back to the flow in FIG. 9A and goes to step S907 and the flow for executing the printing is finished.

As described with reference to FIGS. 6A to 6D, in step S914, it is determined whether or not the margin area exists, on the basis of whether the cut number can be printed without losing the function of the maintenance pattern. Specifically, it is determined that the margin area for printing the cut number exists in the cases of the preliminary discharge pattern in FIG. 6A, the cut mark pattern in FIG. 6B, and the non-discharging monitoring pattern in FIG. 6C. Further, it is determined that the margin area for printing the cut number does not exist in the case of the recovering process pattern in FIG. 6D. The present determination is an example, and the determination for printing the cut number may be changed according to an appearing frequency of the printed product or a purpose of the pattern.

An effect obtained by executing the third embodiment exists in a point that it is possible to prevent an inspecting precision of the inspecting unit 5 from coming down, because it is not necessary to print the cut number in the maintenance pattern where the cut number should not be printed, in addition to the effect of the first embodiment.

In the first to third embodiments, the cut number is printed on the front face (the first face) that is the print subject face of the sheet product. On the contrary, according to a fourth embodiment, there is shown an example in which the cut number is printed on a back face (a second face) of the sheet.

Figure 10:
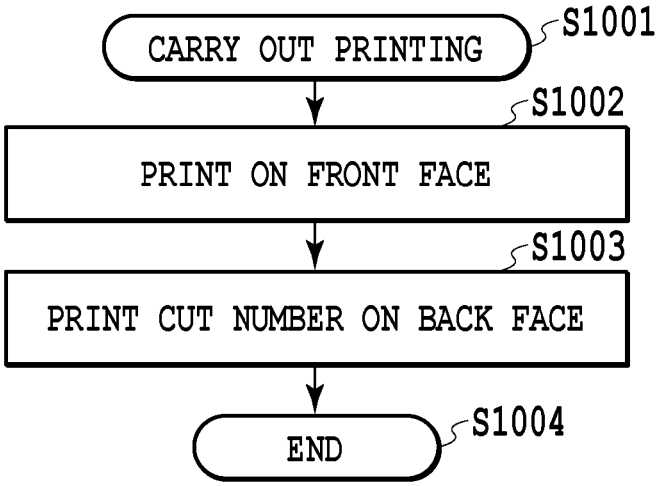
FIG. 10 is a flow chart for describing an operation of a fourth embodiment.

Specifically, in the fourth embodiment, a description will be given of a flow for printing the cut number (the number of the cut sheets) on the back face. A description of the common portions with the printing flow according to the first embodiment which is described with reference to FIGS. 7A and 7B will be omitted, and a description of the different step S703 will be described in detail with reference to FIG. 10. In step S1001 in FIG. 10, execution of the printing is started and the process goes to step S1002. In step S1002, the unit image or the maintenance pattern is printed on the front face (the first face) of the sheet, and the process goes to step S1003. In step S1003, the cut number is printed on the back face (the second face) of the sheet, and the process goes to step S1004, and the present flow is finished. The fourth embodiment can be executed in the case where a printing unit for the back face is provided. In the printing apparatus according to the present embodiment, it is possible to print the cut number, for example, by using the information recording unit 7.

An effect of the fourth embodiment exists in a point that the number of the sheet pieces can be always securely recognized, because the cut number can be printed without affecting the image pattern on the front face.

In the embodiments mentioned above, the numeric value of the cut number is used as the information which indicates the count value of the cut number for checking the number of the sheet pieces within the printing apparatus. However, in the present invention, the information is not limited to this as long as the information can make the user recognize the number and the order of the sheet pieces in the paper jam. For example, the information indicating the count value of the cut number may employ any one of the other numeric values than the cut number, alphabets, the other language letters, the other symbols or marks, and combination thereof. Further, the cut number may be formed as information which can be detected by a sensor provided at a specific position of the feed path. In this case, the cut number of the sheet piece passing through the specific position may be displayed, for example, in a user interface so as to be visually observed by the user.

As mentioned above, the user can recognize the number and the order of the sheet pieces in the paper jam and remove the differential sheet pieces, by checking the cut numbers of at least two sheet pieces.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-169468, filed Jul. 31, 2012, which is hereby incorporated by reference herein in its entirety.

What is claimed is:

1. An apparatus, comprising:

a receiving unit configured to receive image data for printing;

a determination unit configured to determine whether an image to be printed is a unit image or a maintenance pattern image;

a counting unit configured to count a number of sheets each time the unit image or the maintenance pattern image is printed, a printing control unit configured to cause a print unit to print a plurality of images on the continuous sheet, the plurality of images including the unit image based on the received image data and the maintenance pattern image; and a cutting control unit configured to cause a cutting unit to cut the continuous sheet per each of the plurality of images, wherein the printing control unit is configured to cause the print unit to print information indicating the counted number of sheets in a margin area of the maintenance pattern image if the determination unit determines the image to be printed is the maintenance pattern image, wherein the printing control unit is configured to cause the print unit not to print information indicating the counted number of sheets in the unit image if the determination unit determines the image to be printed is the unit image, and wherein the printing control unit is configured to cause the print unit to print first information indicating the counted number of sheets in the margin area of a first maintenance pattern image, not to print first information indicating the counted number of sheets in the unit image, and to print second information indicating the counted number of sheets in the margin area of a second maintenance pattern image if the first maintenance pattern image and the second maintenance pattern image are printed and the unit image is printed between the first maintenance pattern image and the second maintenance pattern image, the numbers of the sheet indicated by the first information and the number of the sheets indicated by the second information are discontinuous.

2. The apparatus according to claim 1, further comprising a trash box into which a sheet piece on which the information is printed is thrown out.

3. The apparatus according to claim 1, wherein if the determination unit determines the image to be printed is the unit image with a margin area that exists adjacent to an image to become a product in the unit image, the information is printed in the margin area of the unit image.

4. The apparatus according to claim 1, wherein, if the determination unit determines the image to be printed is the unit image, the information is printed on a back face of a surface of the continuous sheet on which the unit image is printed.

5. The apparatus according to claim 1, wherein the counting unit counts the number of sheets to be cut each time one of the plurality of images is printed.

6. The apparatus according to claim 1, wherein the information is printed on the same side as the side on which the plurality of images is printed.

7. The apparatus according to claim 1, further comprising the print unit.

8. The apparatus according to claim 1, wherein the information is a number.

9. The apparatus according to claim 1, further comprising a first margin determination unit configured to determine whether the unit image is an image including a margin if the determination unit determines the image to be printed is the unit image, wherein if the determination unit determines the image to be printed is the unit image and the first margin determination unit determines the unit image includes a margin area, the printing control unit causes the print unit to print the information indicating the counted number of sheets in the margin area of the unit image, and wherein if the determination unit determines the image to be printed is the unit image and the first margin determination unit determines the unit image does not include a margin area, the printing control unit causes the print unit not to print the information indicating the counted number of sheets in the unit image.

10. The apparatus according to claim 1, further comprising a second margin determination unit configured to determine whether the maintenance pattern image includes a margin area, wherein if the determination unit determines the image to be printed is the maintenance pattern image and the second margin determination unit determines the maintenance pattern image includes the margin area, the printing control unit causes the print unit to print the information indicating the counted number of sheets in the margin area of the maintenance pattern image, and wherein if the determination unit determines the image to be printed is the maintenance pattern image and the second margin determination unit determines the maintenance pattern image does not include the margin area, the printing control unit causes the print unit not to print the information indicating the counted number of sheets in the maintenance pattern image.

11. A printing method, comprising:

receiving image data for printing;

determining whether an image to be printed is a unit image or a maintenance pattern image;

counting a number of sheets each time the unit image or the maintenance pattern image is printed;

printing a plurality of images on the continuous sheet, the plurality of images including the unit image based on the received image data and the maintenance pattern image; and cutting the continuous sheet per each of the plurality of images, wherein, if it is determined that the image to be printed is the maintenance pattern image, information indicating the counted number of sheets is printed on the continuous sheet in a margin area in the maintenance pattern image, wherein, if the determination unit determines the image to be printed is the unit image, the print information indicating the counted number of sheets is not printed in the unit image, and wherein first information indicating the counted number of sheets is printed in the margin area of a first maintenance pattern image, the print information indicating the counted number of sheets is not printed in the unit image, second information indicating the counted number of sheets is printed in the margin area of a second maintenance pattern image if the first maintenance pattern image and the second maintenance pattern image are printed and the unit image is printed between the first maintenance pattern image and the second maintenance pattern image, the numbers of the sheet indicated by the first information and the number of the sheets indicated by the second information are discontinuous.

12. The printing method according to claim 11, further comprising throwing out a sheet piece on which the information is printed into a trash box.

13. The printing method according to claim 11, wherein, if it is determined that the image to be printed is the unit image and the margin area exists adjacent to an image to become a product in the unit image, the information is printed in a margin area adjacent to an image to become a product in the unit image, and if it is determined that the image to be printed is the unit image and the margin area does not exist adjacent to an image to become a product in the unit image, the information is not printed in the unit image.

14. The apparatus according to claim 1, wherein the maintenance pattern image includes at least one of a non-discharging monitoring pattern, a preliminary discharge pattern, a recovering process pattern, and a cut mark pattern.

* * * * *